United States Patent [19]

Vogel et al.

[11] Patent Number: 4,619,497

[45] Date of Patent: Oct. 28, 1986

[54] DEVICE FOR ESTABLISHING CONNECTIONS BETWEEN ELECTRICAL CONDUCTORS

[75] Inventors: Ernst Vogel, Basel; Fritz Berger, Oberbuchsiten; Armin Stampfli, Grenchen, all of Switzerland

[73] Assignee: Elektro-Apparatebau Olten AG., Olten, Switzerland

[21] Appl. No.: 701,578

[22] Filed: Feb. 14, 1985

[30] Foreign Application Priority Data

Feb. 28, 1984 [CH] Switzerland ..... 960/84

[51] Int. Cl.[4] ..... H01R 13/207

[52] U.S. Cl. ..... 339/244 R; 339/249 A; 339/274

[58] Field of Search ..... 339/244, 246, 249 A, 339/268 R, 273 R, 274, 276 R

[56] References Cited

U.S. PATENT DOCUMENTS

| | | | |
|---|---|---|---|
| 3,305,253 | 2/1967 | Kopich | 339/244 R |
| 3,447,122 | 5/1969 | Beck | 339/273 R |
| 3,803,534 | 4/1974 | Debaight | 339/274 |
| 4,087,149 | 5/1978 | Fischer | 339/244 R |
| 4,279,461 | 7/1981 | Bussen et al. | 339/273 R |

FOREIGN PATENT DOCUMENTS 2221827 3/1974 France .

OTHER PUBLICATIONS

"DuraGrip"; Anderson Brass Works; *Electrical World;* p. 30; May 30, 1955.

*Primary Examiner*—Gil Weidenfeld
*Assistant Examiner*—Paula Austin
*Attorney, Agent, or Firm*—Peter K. Kontler

[57] ABSTRACT

A device for establishing a current-conducting connection between a strip-shaped conducting member and one or more wire-like conductors has a reinforced frame with two mutually inclined internal surfaces which make an angle of 30 degrees. The conducting member is placed against one of the internal surfaces and the conductor or conductors are placed adjacent the conducting member in the interior of the frame. A screw whose axis halves the angle between the two internal surfaces meshes with the frame and carries a clamping element which has an elongated slot for the shank of the screw and which slides along the other internal surface of the frame in response to rotation of the screw to move the clamping element in the direction of convergence of the internal surfaces whereby the clamping element bears against the conductor or conductors and urges them against the conducting member so that the latter is biased against the one internal surface. The slot enables the clamping element to move transversely of the axis of the screw, for example, to become disengaged from the conductor or conductors when the screw is rotated to move the clamping element counter to the direction of convergence of the internal surfaces. The angle between the axis or axes of the conductor or conductors and the axis of the screw is approximately or exactly 15 degrees.

14 Claims, 2 Drawing Figures

DEVICE FOR ESTABLISHING CONNECTIONS BETWEEN ELECTRICAL CONDUCTORS

BACKGROUND OF THE INVENTION

The present invention relates to improvements in devices for establishing current-conducting connections between two or more electrical conductors. More particularly, the invention relates to improvements in devices for establishing current-conducting connections between elongated strip- or slat-shaped conductive members and one or more wire-like conductors. Still more particularly, the invention relates to improvements in devices of the type wherein the conductive member and one or more wire-like conductors can be biased against each other in the interior of a frame-like body by a clamping element which is movable by a screw so as to move the clamping element between two mutually inclined internal surfaces of the frame-like body.

A device of the above outlined character is disclosed in French Pat. No. 2 221 827. The clamping element is caused to slide along one of the internal surfaces to thereby bias the wire-like conductor or conductors against the conductive member which is thereby urged against the other internal surface. An advantage of such devices is that the wire-like conductor or conductors need not be positively clamped to the conductive member. Thus, if the terminals of the wire-like conductors are not provided with sleeves or like connecting components, the frame, the screw and the clamping element can be used as a highly satisfactory expedient for establishing a current-conducting connection between the wire-like conductor or conductors on the one hand and a conducting member on the one hand without necessitating any changes in the construction, wiring and/or other parameters of the structure in a control panel, instrument panel, distribution panel or a like system containing or carrying signal generating, signal transmitting and/or signal displaying parts in the form of switches, knobs, lamps and the like.

A drawback of the patented device is that the axis of the screw for the clamping element makes a rather large angle with the axis or axes of the wire-like conductor(s) which must be connected to the conducting member. This can create problems because the space in or adjacent to a control panel is often at a premium so that there is no room for insertion and manipulation of a screwdriver or another torque transmitting tool which is used to rotate the screw in a direction to move the clamping element into or away from engagement with one or more wire-like conductors.

OBJECTS AND SUMMARY OF THE INVENTION

An object of the invention is to provide a device which can reliably, rapidly and releasably establish a current-conducting connection between a conducting member and one or more wire-like conductors in such a way that the screw which is used to shift the clamping element into and from clamping engagement with the conductor or conductors can be readily reached and manipulated even if the space which is available in the region of the device is minimal and does not suffice for proper manipulation of screws in conventional connection-establishing devices.

Another object of the invention is to provide a device which can be used as a superior substitute for heretofore known connection-establishing devices under circumstances when the conventional devices are either hard to manipulate or can be adequately manipulated only by highly skilled persons and/or by using specially designed tools.

A further object of the invention is to provide a novel and improved connection between the screw and the clamping element in the above outlined improved connection establishing device.

An additional object of the invention is to provide a novel and improved method of establishing and terminating current-conducting connections between the naked terminal or terminals of one or more wire-like conductors and a substantially strip- or slat-shaped conducting member in or on control panels and like structures.

Another object of the invention is to provide a novel and improved frame for use in the above outlined device.

The invention resides in the provision of a device for electrically connecting a conductive member, particularly a flat strip-shaped conductive member, with at least one wire-like conductor. The improved device comprises a frame having opposing convergent first and second internal surfaces which make an acute angle. The conductive member is inserted into the frame so that it is adjacent the first internal surface and the wire-like conductor or conductors are placed adjacent the conductive member so that the latter is disposed between the conductor or conductors and the first internal surface. The device further comprises means for releasably biasing and clamping the conductor or conductors against the conductive member, and such biasing means includes a screw which meshes with the frame so that its axis at least substantially halves the acute angle between the two internal surfaces, and a clamping element which has a slot-shaped opening for the screw and is mounted thereon for movement with the screw in the direction of the axis of the screw as well as transversely of such axis in response to rotation of the screw. The clamping element has a first marginal portion which contacts the conductor or conductors in the interior of the frame and a second marginal portion which is slidable along the second internal surface of the frame to bias the conductor or conductors against the conductive member by way of the first marginal portion and to bias the conductive member against the first internal surface in response to rotation of the screw in a direction to move the clamping element in the frame in the direction of convergence of the first and second internal surfaces.

The frame includes several sidewalls including first and second sidewalls which are respectively provided with the first and second internal surfaces, and the frame preferably further comprises a reinforcing or stiffening bottom wall at that end of the frame where the two internal surfaces are nearest to each other. The bottom wall has a tapped bore for the shank of the screw and a slot for insertion of the conductive member into the interior of the frame adjacent the first internal surface.

The first marginal portion of the clamping element can be provided with one or more (preferably two) concave sockets for portions of wire-like conductors.

The shank of the screw preferably includes a cylindrical portion which is adjacent to the head of the screw and is received in the slot-shaped opening of the clamping element. Means is preferably provided for permanently securing the clamping element to the shank with freedom of movement transversely of the axis of the screw.

The device preferably further comprises a cam which is disposed in the frame and has a cam face which is at least substantially parallel to and spaced apart from the second internal surface of the frame. Such cam face is located in the path of movement of the first marginal portion of the clamping element counter to the direction of convergence of the first and second internal surfaces so that the cam automatically shifts the clamping element transversely of the axis of the screw and away from the first internal surface (to thereby disengage the first marginal portion from the conductor or conductors) in response to rotation of the screw in a direction to move the clamping element counter to the direction of convergence of the first and second internal surfaces. The cam can constitute a discrete part which is insertable into and withdrawable from the frame, or such cam can be rigid (e.g., integral) with the frame.

The aforementioned angle preferably equals or closely approximates 30 degrees.

The frame can be installed in a housing having a detachable wall to permit insertion of the frame into or its removal from the housing.

The projection of the clamping element into a plane which is parallel to the axis of the screw and intersects the first and second internal surfaces of the frame has or can have a V-shaped outline.

The novel features which are considered as characteristic of the invention are set forth in particular in the appended claims. The improved device itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
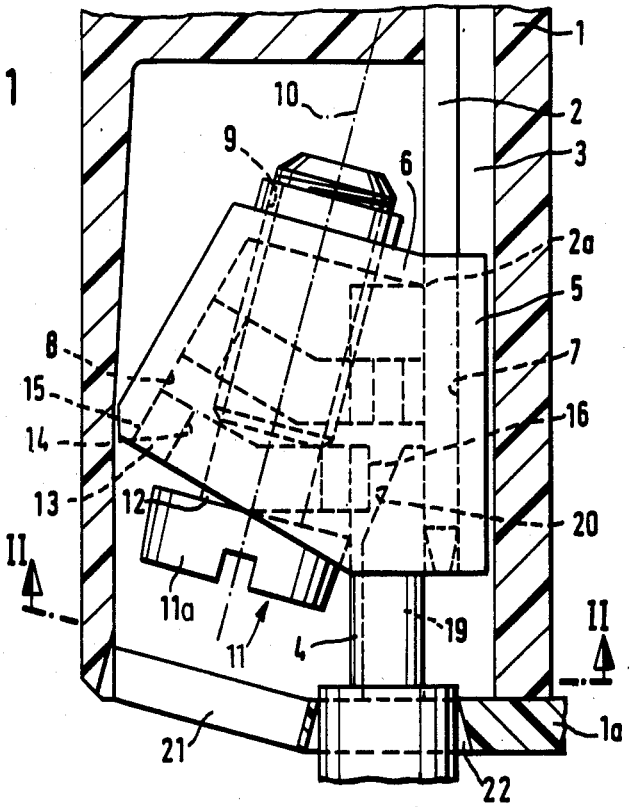
FIG. 1 is a schematic side elevational view of the improved connection-establishing device as seen in the direction of arrows from the line I—I of FIG. 2, a portion of the housing for the frame being shown in section.
Figure 2:
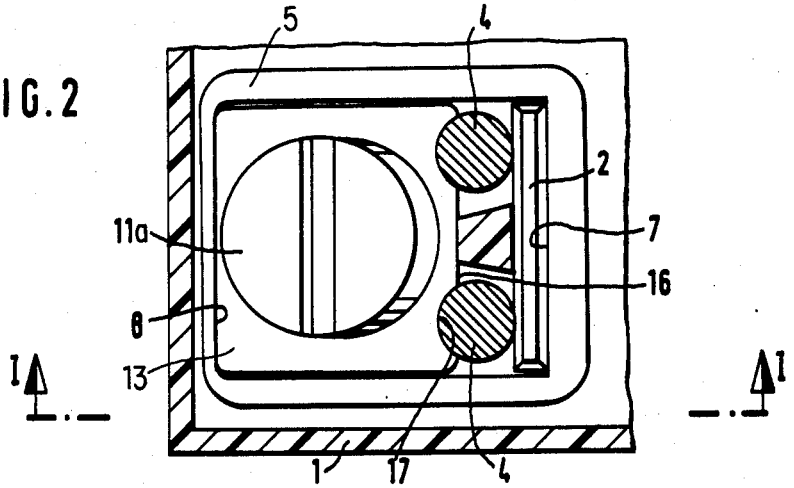
FIG. 2 is an end elevational view of the device as seen in the direction of arrows from the line II—II of FIG. 1.

Referring to the drawing in detail, the reference character 1 denotes the rear wall of a housing of a signal transmitting, signal displaying or like apparatus which can be installed in or on a control panel, instrument board or the like. The improved device is installed in the housing and includes a frame 5 having a reinforcing bottom wall 6 provided with a slot 2*a* for insertion of a portion of a conducting member 2 in the form of a strip or slat. The conducting member 2 is insertable into the frame 5 along the inner side of the rear wall 1 of the housing and is then adjacent a first internal surface 7 which is located opposite a second internal surface 8. The surfaces 7 and 8 make an acute angle of preferably 30 degrees and converge in a direction toward the bottom wall 6 of the frame 5. The conducting member 2 is to be placed into reliable current-conducting engagement with one or more wire-like conductors 4 which are introduced into the housing through an opening 22 in a detachable bottom wall 1*a* of the housing. The terminal or terminals of the conductor or conductors 4 (two such conductors are shown in FIG. 2) are adjacent to that side of the member 2 which faces away from the internal surface 7 of the frame 5. The housing including the walls 1 and 1*a* can contain a battery of conducting members 2 and a discrete frame 5 for each member 2. The space through which a portion of the illustrated conducting member 2 extends in the interior of the housing adjacent to the inner side of the rear wall 1 is indicated by the character 3. As shown in FIG. 1, the external surface of one sidewall of the frame 5 can be placed close to or into actual abutment with the inner side of the rear wall 1. The frame 5 can be inserted into or withdrawn from the housing upon detachment of the bottom wall 1*a*. As also shown in FIG. 1, the dimensions of that portion of the space 3 which receives the major part of the frame 5 are such that the frame can be held against tilting in the interior of the housing and maintains the slot 2*a* in the bottom wall 6 in an optimum position for insertion of the conducting member 2. Furthermore, when the frame 5 is properly inserted into the housing including the walls 1 and 1*a*, the opening 22 allows for convenient introduction of the terminal or terminals of one or more wire-like conductors 4 into the housing and through the open end of the frame 5 to optimum positions adjacent to the exposed side of the conducting member 2.

If the conductors 4 are equipped with customary sleeves, they can be slipped onto the conducting member 2 and the frame 5 is not needed. The bottom wall 1*a* is then replaced with a different bottom wall which has an opening that is large enough for introduction of a conductor and its sleeve for engagement with the conducting member 2. The improved device including the frame 5 is used when the conductors 4 are not provided with sleeves so that they cannot be slipped onto the conducting member 2.

The purpose of the bottom wall 6 of the frame 5 is to reinforce or stiffen the entire frame as well as to provide a tapped bore 9 for the externally threaded shank of a screw 11 whose axis 10 halves the acute angle between the internal surfaces 7 and 8 and whose head 11*a* is accessible by way of a second opening 21 in the bottom wall 1*a*. The lower end of the frame 5, as viewed in FIG. 1, is open and is adjacent to the inner side of the detachable bottom wall 1*a* of the housing for the frame.

That portion 12 of the shank of the screw 11 which is immediately adjacent to the head 11*a* is a relatively short cylinder which is received in a transversely extending slot-shaped opening 14 of a substantially V-shaped clamping member 13. The latter is mounted on the screw 11 against axial movement relative thereto but is movable transversely of the axis 10 in directions toward and away from the internal surfaces 7 and 8 of the frame 5. The manner in which the clamping element 13 is more or less permanently secured to the shank of the screw 11 for axial movement therewith is not specifically shown; for example, that portion of the clamping element 13 which directly surrounds the slot-shaped opening 14 can extend into a circumferential groove of the screw 11 so that the clamping element is free to move transversely of the axis 10 but is compelled to share all axial movements of the screw 11.

That marginal portion (16) of the clamping element 13 which is adjacent to the conductors 4 has one or more (preferably two) concave sockets 17 for portions of the adjacent conductors so that such conductors are held against movement in the longitudinal direction of the marginal portion 16. The other marginal portion 15 of the clamping element 13 is adjacent to and is slidable along the internal surface 8 of the frame 5.

When the conducting member 2 is properly inserted into the housing and into the interior of the frame 5 so that it is adjacent to the internal surface 7, and when the terminals of the conductors 4 are properly inserted through the opening 22 and are adjacent to the exposed side of the member 2, the clamping element 13 is held in a retracted position close to the open end of the frame 5. The screw 11 is then rotated in a clockwise direction, as viewed in FIG. 2, so as to move its head 11*a* nearer to the bottom wall 6 whereby the marginal portion 15 of the clamping element 13 is caused to slide along the internal surface 8 in the direction in which the surfaces 7 and 8 converge (i.e., toward the bottom wall 6) and the marginal portion 16 slides in the same direction to thereby urge the conductors 4 against the member 2 so that the member 2 is biased against the internal surface 7. As the marginal portion 15 slides along the internal surface 8, the clamping element 13 moves transversely of the axis 10 and thereby places the marginal portion 16 into progressively increasing clamping engagement with the conductors 4 so that the conductors and the member 2 are clamped between the internal surface 7 and the marginal portion 16. The resulting current-conducting connection between the member 2 and the conductors 4 is highly satisfactory and reliable.

In order to ensure that the marginal portion 16 of the clamping element 13 is invariably moved away from the member 2 and away from the surface 7 and releases the conductors 4 when the screw 11 is rotated in a counterclockwise direction, as viewed in FIG. 2, the improved device preferably further comprises a cam 19 which is inserted into the open end of the frame 5 (i.e., it is remote from the bottom wall 6) and has a cam face 20 which is substantially or exactly parallel with the internal surface 8. The cam face 20 is located in the path of movement of the marginal portion 16 in a direction away from the bottom wall 6 when the screw 11 is rotated in a counterclockwise direction, as viewed in FIG. 2, to move the clamping element 13 away from the bottom wall 6 and toward the open end of the frame 5. This ensures that the marginal portion 15 continues to slide along the internal surface 8 and the distance between the internal surface 7 and the marginal portion 16 increases. The cam 19 extends into the frame 5 through the opening 22 of the detachable bottom wall 1*a*. If desired, the cam 19 can be affixed to the frame 5.

As can be seen in FIG. 2, the configuration of the clamping element 13 and of the compartment in the frame 5 can be such that the frame automatically holds the clamping element 13 against rotation with the shank of the screw 11. Due to the establishment of a connection between the shank of the screw 11 and the clamping element 13 to ensure that the clamping element must share the movements of the screw in the direction of the axis 10 when the head 11*a* is rotated by a screwdriver or a like tool which is inserted through the opening 21 of the bottom wall 1*a*, the clamping element 13 invariably moves toward or away from the bottom wall 6 when the screw 11 is rotated.

If the illustrated conductors 4 are replaced with conductors whose sleeves can be slipped onto conducting members 2, the bottom wall 1*a* is replaced with a different bottom wall which, as stated above, has openings large enough for insertion of such sleeves into the interior of the housing and into adequate current-conducting engagement with the adjacent conducting member or members 2. The frame 5 is then withdrawn from the interior of the housing including the wall 1 before the other (non-illustrated) bottom wall is attached to the wall 1 in lieu of the wall 1*a*. The replacement of the illustrated bottom wall 1*a* with the modified bottom wall and vice versa takes up very little time.

The provision of the bottom wall 6 on the frame 5 is optional but desirable and advantageous. This bottom wall enhances the stability of the frame and renders it possible to apply the screw 11 and the clamping element 13 with a great force to exclude the likelihood of possibility of accidental termination of current-conducting connection between the conducting member 2 and one or more wire-like conductors without sleeves. It has been found that the illustrated frame 5 is not likely to be deformed even if the screw 11 is applied with a great force. The force can be sufficiently pronounced to allow for simultaneous engagement of two or more wire-like conductors with a strip-shaped conducting member 2. The provision of concave sockets 17 in the marginal portion 16 of the clamping element 13 is also optional but desirable and advantageous. Such sockets ensure that the conductors 4 are maintained at a predetermined distance from each other and engage selected portions of the exposed side of the member 2. The depth of the sockets 17 can be increased beyond or reduced below the depth of the sockets which are shown in FIG. 2.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A device for electrically connecting a conductive member, particularly a flat conductive member, with at least one wire-like conductor, comprising a frame having opposing convergent first and second internal surfaces making an acute angle, said first surface being contacted by the conductive member and the wire-like conductor being located in the frame adjacent said conductive member; and means for releasably biasing the conductor against the conductive member in said frame, including a screw meshing with said frame so that the inclination of its axis with reference to said frame is fixed and such axis at least substantially halves said acute angle, and a clamping element having a slot-shaped opening for said screw and being arranged to move in the direction of said axis as well as transversely of said axis in response to rotation of said screw, said clamping member having a first marginal portion contacting the conductor in said frame and a second marginal portion slidable along said second internal surface to bias the conductor against the conductive member by way of said first marginal portion and to bias the conductive member against said first internal surface by way of the conductor in response to rotation of said screw to move said clamping member in its frame and in the direction of convergence of said internal surfaces.

2. The device of claim 1, wherein said acute angle equals or closely approximates 30 degrees.

3. The device of claim 1, further comprising a housing removably receiving said frame.

4. The device of claim 1, wherein said clamping element has a substantially V-shaped outline.

5. The device of claim 1, wherein said frame includes several sidewalls including first and second sidewalls which are respectively provided with said first and second internal surfaces, and a bottom wall at that end of said frame where said surfaces are nearest to each other.

6. The device of claim 5, wherein said bottom wall has a tapped bore for said screw.

7. The device of claim 5, wherein said bottom wall has a slot for insertion of the conductive member into the interior of said frame and adjacent said first internal surface.

8. The device of claim 1, wherein the first marginal portion of said clamping member has at least one substantially concave socket for a portion of a wire-like conductor.

9. The device of claim 8, wherein said first marginal portion has two concave sockets.

10. The device of claim 1, wherein said screw has a shank including a cylindrical portion in the opening of said clamping element.

11. The device of claim 10, further comprising means for permanently securing said clamping element to said shank with freedom of movement transversely of said axis.

12. A device for electrically connecting a conductive member, particularly a flat conductive member, with at least one wire-like conductor, comprising a frame having opposing convergent first and second internal surfaces making an acute angle, said first surface being contacted by the conductive member and the wire-like conductor being located in the frame adjacent said conductive member; means for releasably biasing the conductor against the conductive member in said frame, including a screw meshing with said frame so that its axis at least substantially halves said acute angle, and a clamping element having a slot-shaped opening for said screw and being arranged to move in the direction of said axis as well as transversely of said axis in response to rotation of said screw, said clamping member having a first marginal portion contacting the conductor in said frame and a second marginal portion slidable along said second internal surface to bias the conductor against the conductive member by way of said first marginal portion and to bias the conductive member against said first internal surface by way of the conductor in response to rotation of said screw to move said clamping member in said frame and in the direction of convergence of said internal surfaces; and a cam disposed in said frame and having a cam face which is at least substantially parallel to and spaced apart from said second internal surface, said cam face being located in the path of movement of said first marginal portion counter to the direction of convergence of said internal surfaces so that said cam automatically moves the clamping element transversely of said axis and away from said first internal surface in response to rotation of said screw in a direction to move said clamping element counter to the direction of convergence of said surfaces.

13. The device of claim 12, wherein said cam constitutes a discrete part which is insertable into and retractable from said frame.

14. The device of claim 12, wherein said cam is rigid with said frame.

* * * * *